US009618007B2

(12) United States Patent
Iyer

(10) Patent No.: US 9,618,007 B2
(45) Date of Patent: Apr. 11, 2017

(54) BLOWER ASSEMBLY

(71) Applicant: VISTEON GLOBAL TECHNOLOGIES, INC., Van Buren Township, MI (US)

(72) Inventor: Jayanthi Iyer, Northville, MI (US)

(73) Assignee: HANON SYSTEMS, Daejeon-si (KR)

( * ) Notice: Subject to any disclaimer, the term of this patent is extended or adjusted under 35 U.S.C. 154(b) by 541 days.

(21) Appl. No.: 13/827,955

(22) Filed: Mar. 14, 2013

(65) Prior Publication Data

US 2014/0003927 A1 Jan. 2, 2014

Related U.S. Application Data

(60) Provisional application No. 61/666,377, filed on Jun. 29, 2012.

(51) Int. Cl.

| | |
|---|---|
| ***F04D 29/24*** | (2006.01) |
| ***F04D 29/44*** | (2006.01) |
| ***F04D 29/16*** | (2006.01) |

(52) U.S. Cl.

CPC ..... *F04D 29/245* (2013.01); *F04D 29/162* (2013.01); *F04D 29/242* (2013.01); *F04D 29/441* (2013.01); *F04D 29/444* (2013.01)

(58) Field of Classification Search

CPC ..... F04D 29/245; F04D 25/06; F04D 25/08; F04D 29/441; F04D 29/444; F04D 29/462; F04D 29/242; F04D 29/162; F01D 9/04; F01D 9/041

USPC ..... 415/191, 192, 208.1–208.3, 206, 211.1, 415/186, 188, 224

See application file for complete search history.

(56) References Cited

U.S. PATENT DOCUMENTS

| | | | | | |
|---|---|---|---|---|---|
| 1,931,692 | A | * | 10/1933 | Good | 415/191 |
| 2,233,983 | A | * | 3/1941 | Kice, Jr. | 415/160 |
| 2,290,423 | A | * | 7/1942 | Funk | 415/151 |
| 2,435,092 | A | * | 1/1948 | Meyer | 415/160 |
| 2,727,680 | A | * | 12/1955 | Madison et al. | 415/191 |
| 2,834,536 | A | * | 5/1958 | McDonald | 415/150 |
| 3,019,963 | A | * | 2/1962 | Eck | 415/204 |
| 3,093,299 | A | * | 6/1963 | Hammann et al. | 415/90 |
| 3,583,827 | A | * | 6/1971 | Wood | 415/159 |
| 3,781,127 | A | * | 12/1973 | Wood | 415/147 |
| 4,177,007 | A | * | 12/1979 | Schlangen et al. | 415/160 |
| 4,299,535 | A | * | 11/1981 | Brockman et al. | 415/160 |

(Continued)

FOREIGN PATENT DOCUMENTS

| | | | |
|---|---|---|---|
| JP | 1957001889 | B | 11/1946 |
| JP | 1954008378 | Y | 7/1954 |

(Continued)

*Primary Examiner* — Alexander Comley

(74) *Attorney, Agent, or Firm* — Fraser Clemens Martin & Miller LLC; James D. Miller

(57) ABSTRACT

A blower assembly includes a housing having a blower wheel disposed therein and a pre-swirler disposed in a fluid inlet of the housing. The pre-swirler includes an array of spaced apart vanes extending radially outwardly from a central hub. The vanes extend from the hub to an outer ring that is attached to the housing of the blower assembly. The vanes are configured to cooperate with the blower wheel to minimize a noise, a vibration, and a harshness (NVH) of the blower assembly, while maximizing an efficiency thereof.

13 Claims, 2 Drawing Sheets

(56) References Cited

U.S. PATENT DOCUMENTS

| | | | | | |
|---|---|---|---|---|---|
| 4,549,848 | A * | 10/1985 | Wallman | F04D 29/4213 | 415/206 |
| 4,566,852 | A * | 1/1986 | Hauser | 415/220 | |
| 5,183,382 | A * | 2/1993 | Carroll | 415/173.6 | |
| 5,601,400 | A * | 2/1997 | Kondo et al. | 415/119 | |
| 5,813,831 | A * | 9/1998 | Matsunaga | F04D 29/4213 | 415/173.6 |
| 5,951,245 | A * | 9/1999 | Sullivan | F04D 29/4213 | 415/121.2 |
| 6,092,988 | A * | 7/2000 | Botros | F04D 29/4213 | 415/191 |
| 6,878,056 | B2 * | 4/2005 | Robinson | 454/261 | |
| 2005/0074332 | A1 * | 4/2005 | Adamski et al. | 415/211.1 | |
| 2008/0187439 | A1 * | 8/2008 | Iyer | 415/204 | |
| 2012/0171032 | A1 * | 7/2012 | Goenka | F04D 29/441 | 415/224 |

FOREIGN PATENT DOCUMENTS

| | | | |
|---|---|---|---|
| JP | 11978002003 | U | 1/1978 |
| JP | 11978143101 | U | 11/1978 |
| JP | 2003254297 | A | 9/2003 |
| JP | 2008240726 | A | 10/2008 |

* cited by examiner

BLOWER ASSEMBLY

CROSS-REFERENCE TO RELATED APPLICATION

This application claims the benefit of U.S. Provisional Patent Application Ser. No. 61/666,377 filed Jun. 29, 2012, the entire disclosure of which is hereby incorporated herein by reference.

FIELD OF THE INVENTION

The invention relates to a blower assembly and more particularly to a blower assembly including a pre-swirler for causing air entering the blower assembly to change direction.

BACKGROUND OF THE INVENTION

Centrifugal blower assemblies are commonly used in the automotive, air handling, and ventilation industries for directing a forced flow of air through air conditioning components. In a typical blower assembly, air is caused to flow into a housing through an inlet aperture formed therein. The blower assemblies typically include an electrically driven blower wheel that rotates in a predetermined direction in the housing. The blower wheel includes one or more curved blades, which cause the air to flow into an inlet of the blower wheel axially along an axis of rotation and discharge the air radially outwardly therefrom into an air duct formed in the housing.

Blower assemblies in automotive applications have been fitted with pre-swirlers to cause a rotation or swirling of air entering the blower assembly. The pre-swirlers cause the air to enter the blower wheel of the blower assembly at a preferred angle. If the air is not rotated sufficiently, an increase in drag, noise, vibration, and a loss of efficiency of the blower assembly can occur. Accordingly, if the air is pre-rotated and enters the blades of the impeller with a desired amount of rotation, the efficiency of the blower assembly can be maximized.

It would be desirable to produce a blower assembly including a pre-swirler configured to cooperate with a blower wheel of the blower assembly to minimize a noise, a vibration, and a harshness (NVH) of the blower assembly, while maximizing an efficiency thereof.

SUMMARY OF THE INVENTION

In concordance and agreement with the present invention, a blower assembly including a pre-swirler configured to cooperate with a blower wheel of the blower assembly to minimize a noise, a vibration, and a harshness (NVH) of the blower assembly, while maximizing an efficiency thereof, has surprisingly been discovered.

In one embodiment, a blower assembly comprises: a housing including a fluid inlet and a spaced apart fluid outlet; a blower wheel disposed in the housing, the blower wheel including an inlet ring and plurality of spaced apart blades; and a pre-swirler disposed in the fluid inlet of the housing, the pre-swirler including at least one vane having a leading edge, a trailing edge, and an outer edge extending between the leading edge and the trailing edge, wherein at least one of a blade exposure distance is less than about 10 mm and a blower wheel overlap distance is greater than about 5.5 mm.

In another embodiment, a blower assembly comprises: a housing including a fluid inlet and a spaced apart fluid outlet; a blower wheel disposed in the housing, the blower wheel including an inlet ring and plurality of spaced apart blades; and a pre-swirler disposed in the fluid inlet of the housing, the pre-swirler including at least one vane having a leading edge, a trailing edge, and an outer edge extending between the leading edge and the trailing edge, wherein a blade exposure distance is in a range of about 4.0 mm to about 9.5 mm.

In yet another embodiment, a blower assembly comprises: a housing including a fluid inlet and a spaced apart fluid outlet; a blower wheel disposed in the housing, the blower wheel including an inlet ring and plurality of spaced apart blades; and a pre-swirler disposed in the fluid inlet of the housing, the pre-swirler including at least one vane having a leading edge, a trailing edge, and an outer edge extending between the leading edge and the trailing edge, wherein a blower wheel overlap distance is in a range of about 6.5 mm to about 10.0 mm.

DESCRIPTION OF THE DRAWINGS

The above, as well as other objects and advantages of the invention, will become readily apparent to those skilled in the art from reading of the following detailed description of a preferred embodiment of the invention when considered in the light of the accompanying drawings in which.

DETAILED DESCRIPTION OF EXEMPLARY EMBODIMENTS OF THE INVENTION

The following detailed description and appended drawings describe and illustrate various exemplary embodiments of the invention. The description and drawings serve to enable one skilled in the art to make and use the invention, and are not intended to limit the scope of the invention in any manner.

Figure 1:
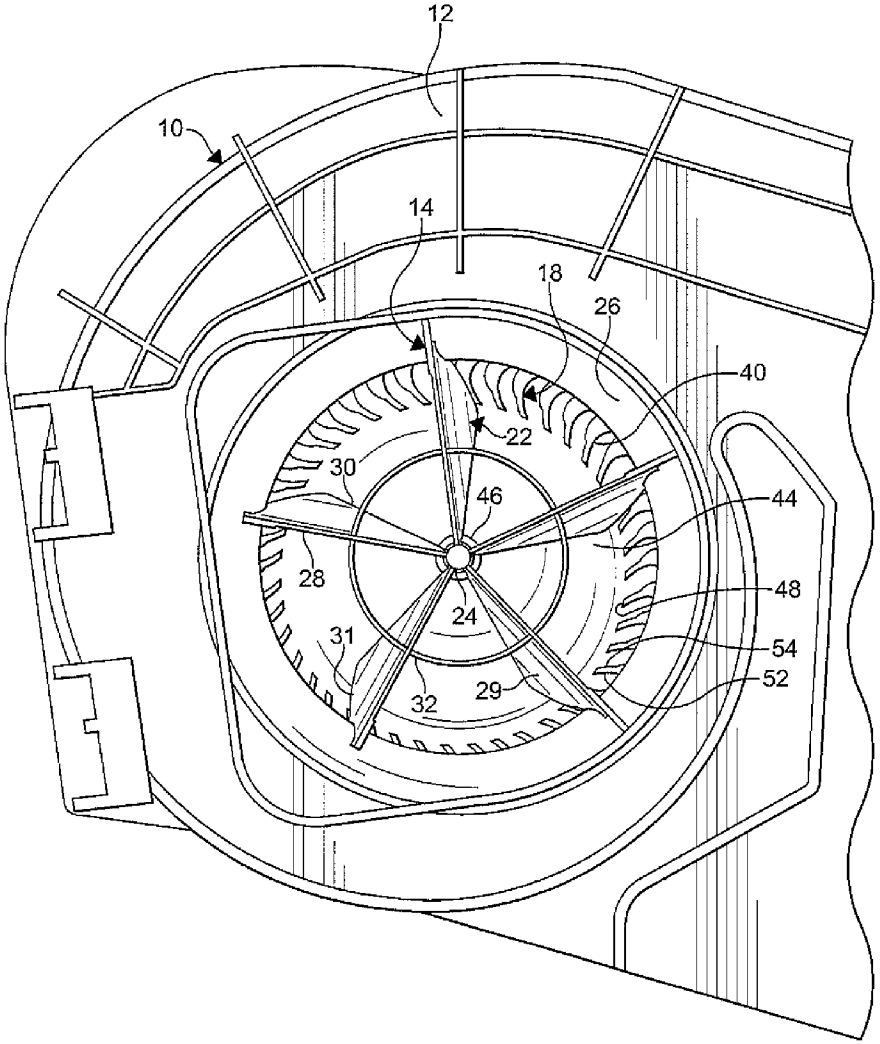
FIG. 1 is a fragmentary front elevational view of a blower assembly including a pre-swirler according to an embodiment of the invention.

FIG. 1 shows a blower assembly 10 according to the present invention. The blower assembly 10 is configured to be employed in a climate control system of a vehicle (not shown). It is understood that the blower assembly 10 can be used in other applications and systems as desired. The blower assembly 10 shown includes a housing 12, a pre-swirler 14, and a blower wheel 18. It is understood that the blower assembly 10 can include other components as necessary for operation such as a motor for causing a rotation of the blower wheel 18, for example. The housing 12, the pre-swirler 14, and the blower wheel 18 shown are formed from plastic. However, it is understood that each of the housing 12, the pre-swirler 14, and the blower wheel 18 can be formed from any suitable material as desired.

Figure 2:
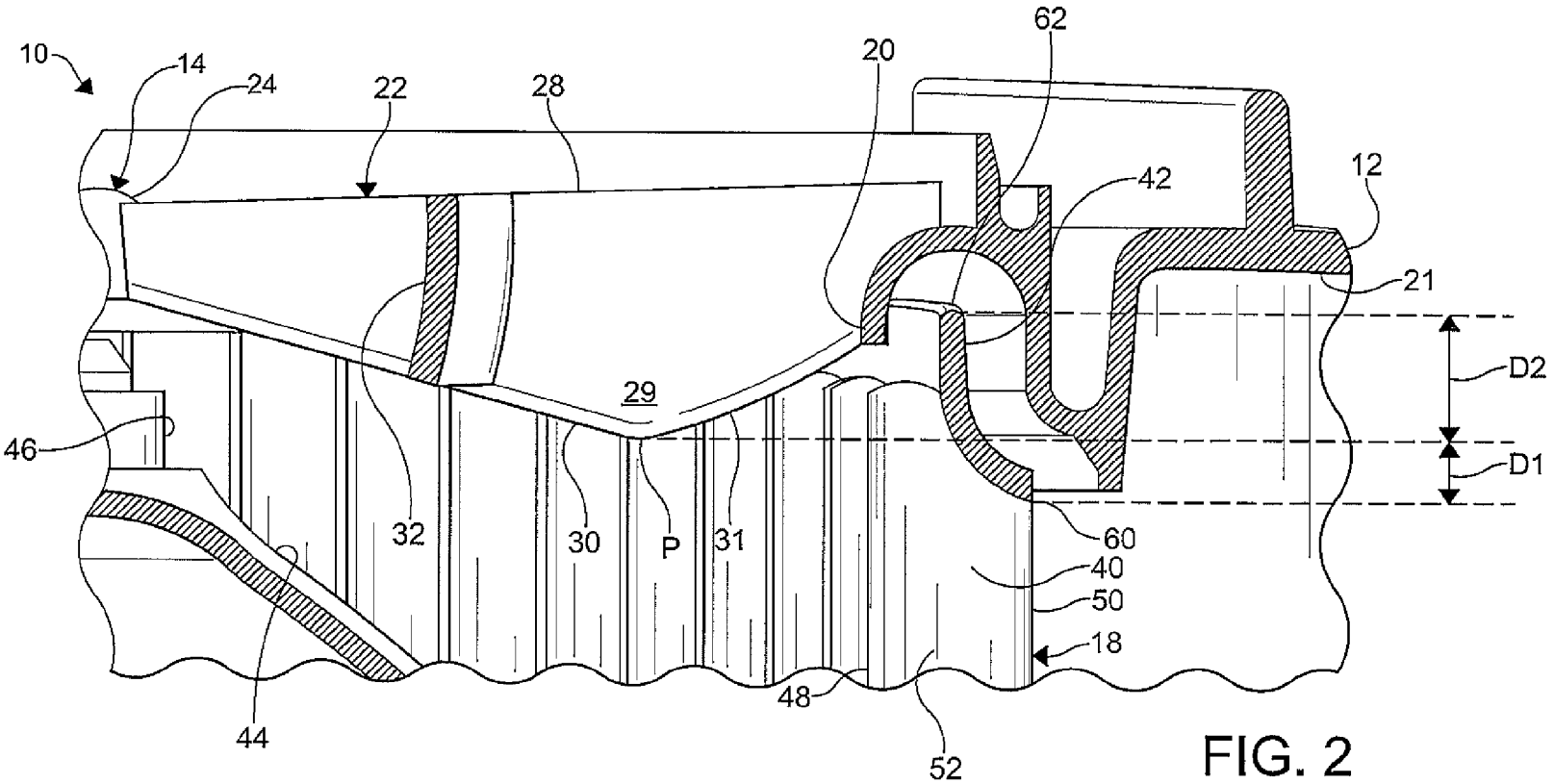
FIG. 2 is an enlarged fragmentary cross-sectional view of the blower assembly illustrated in FIG. 1.

The housing 12 includes a fluid inlet 20 and a fluid duct 21 (shown in FIG. 2) having a fluid outlet (not shown) formed therein. The pre-swirler 14 is disposed in the fluid inlet 20. It is understood that the pre-swirler 14 can be formed integrally with the housing 12, as shown in FIG. 2, or separately therefrom as desired. It is also understood that the fluid inlet 20 and the pre-swirler 14 can be positioned elsewhere in the housing 12 as desired. As shown in FIG. 1, the pre-swirler 14 includes an annular array of spaced apart vanes 22 extending radially outwardly from a central hub 24.

In the embodiment shown, the pre-swirler 14 includes five (5) vanes 22. It is understood that additional or fewer vanes 22 can be used as desired. The vanes 22 extend from the hub 24 to an outer ring 26 that is attached to the housing 12. It is understood that if the pre-swirler 14 is formed integrally with the housing 12, the outer ring 26 is formed as a part of the housing 12. It is noted that the pre-swirler 14 is substantially stationary relative to the housing 12. While the pre-swirler 14 shown in FIGS. 1 and 2 is generally circular in shape, it is understood that the pre-swirler 14 can have any shape as desired.

The vanes 22 of the pre-swirler 14 each include a substantially linear leading edge 28 extending along an entire length of the vane 22. The vanes 22 also include a trailing edge 30 spaced from the leading edge 28 and extending radially and axially outwardly from the hub 24 at an angle with respect to the leading edge 28. It is understood that the trailing edge 30 may extend from the hub 24 in other directions as desired. A substantially radially and axially extending outer edge 31 extends between the outer ring 26 and the trailing edge 30, and joins with the trailing edge 30 at a point P. The outer edge 31 is a curved or arcuate edge, although the outer edge may have other shapes as desired such as linear, for example. It is understood that other configurations can be used as desired, such as wherein the leading edge 28 and the trailing edge 30 merge at a point (not shown) prior to the edges 28, 30 reaching the outer ring 26, for example. The vanes 22 include a first surface 29 and an opposed second surface (not shown) extending from the leading edge 28 to the trailing edge 30. The first surface 29 can have a substantially concave shape from the leading edge 28 to the trailing edge 30 in respect of a direction of rotation of the blower wheel 18 and the second surface can have a substantially convex shape from the leading edge 28 to the trailing edge 30 in respect of a direction of rotation of the blower wheel 18. It is understood, however, that the first surface 29 and the second surface can have any shape as desired such as a substantially concave shape in respect of the direction of rotation of the blower wheel 18, a substantially convex shape in respect of the direction of rotation of the blower wheel 18, a substantially planar shape, or an irregular shape, for example. As illustrated, the pre-swirler 14 may also include an inner ring 32 spaced radially outwardly from the hub 24 between the hub 24 and the outer ring 26. The inner ring 32 interconnects each of the vanes 22 to provide support to the vanes 22 and maximize a structural integrity of the pre-swirler 14.

With renewed reference to FIG. 2, the blower wheel 18 includes an annular array of spaced apart blades 40 extending between an inlet ring 42 and a hub 44. Although the hub 44 shown is generally dome-shaped having a nose portion 46 formed at an apex thereof, it is understood that the hub 44 can have shape and size as desired. In certain embodiments, the blades 40 are arranged on an outer periphery of the hub 44 at equal intervals with respect to an axis of rotation of the blower wheel 18, although other intervals can be used. Additional or fewer blades 40 than shown can be employed if desired. Each of the blades 40 includes a substantially linear leading edge 48 and a substantially linear trailing edge 50 extending from the hub 44 to the inlet ring 42. Each of the blades 40 further includes a first surface 52 and an opposed second surface 54 (shown in FIG. 1). In certain embodiments, the first surface 52 can have a substantially concave shape in respect of the direction of rotation of the blower wheel 18 and the second surface 54 can have a substantially convex shape in respect of the direction of rotation of the blower wheel 18. It is understood, however, that the first surface 52 and the second surface 54 can have any shape as desired such as a substantially concave shape in respect of the direction of rotation of the blower wheel 18, a substantially convex shape in respect of the direction of rotation of the blower wheel 18, a substantially planar shape, or an irregular shape, for example.

As illustrated in FIG. 2, the pre-swirler 14 is configured to cooperate with the blower wheel 18 such that a distance $D_1$ between the points P of the vanes 22 and ends 60 of the trailing edges 50 of the blades 40, also referred to as a blade exposure distance, is less than about 10 mm. In a non-limiting example, the blade exposure distance is in a range of about 4.0 mm to about 9.5 mm. Since the distance $D_1$ between the points P of the vanes 22 of the pre-swirler 14 and the ends 60 of the trailing edges 50 of the blades 40 of the blower wheel 18 of the present invention is less than prior art assemblies, an amount of the air caused to flow into the blower wheel 18 is increased, and thereby a mechanical efficiency and an airflow of the blower assembly 10 are maximized. Additionally, a noise, vibration, and harness (NVH) of the blower assembly 10 is minimized.

The pre-swirler 14 is also configured to cooperate with the blower wheel 18 such that a distance $D_2$ between a peripheral planar surface 62 of the inlet ring 42 and the points P of the vanes 22, also referred to as a blower wheel overlap distance, is greater than about 5.5 mm. As a non-limiting example, the blower wheel overlap distance is in a range of about 6.5 mm to about 10.0 mm. Since the distance $D_2$ between the peripheral planar surface 62 of the inlet ring 42 and the points P of the vanes 22 is more than prior art assemblies, an amount of air re-circulated into the blower wheel 18 from the fluid duct 21 is decreased, and thereby the mechanical efficiency and the airflow of the blower assembly 10 are further maximized. Additionally, the NVH of the blower assembly 10 is further minimized.

The blower assembly 10 having the pre-swirler 14 configured to cooperate with the blower wheel 18 as described hereinabove provides significant advantages over the prior art blower assemblies. For example, a percentage improvement in the mechanical efficiency of the blower assembly 10 having the pre-swirler 14 configured according to the present invention over the prior art blower assemblies without any pre-swirler is about 4.6%. This percentage improvement is greater than a percentage improvement of the prior art blower assemblies with a prior art pre-swirler over the prior art blower assemblies without any pre-swirler of about 2.8%.

In use, the blower wheel 18 is driven by the motor and is caused to rotate about a central axis of rotation. The rotation of the blower wheel 18 causes the air to flow through the fluid inlet 20 of the housing 12. The first surfaces 29 of the vanes 22 cause a change of direction of the air in a direction substantially parallel to the first surface 29. It is understood that the second surfaces of the vanes 22 may also cause a change of direction of the air. Accordingly, the air flows out of the fluid inlet 20 in a different direction than the air entering the fluid inlet 20. Thereafter, the blower wheel 18 causes the air to flow into and through the fluid duct 21 having the fluid outlet out of the blower assembly 10 to a desired area (not shown).

From the foregoing description, one ordinarily skilled in the art can easily ascertain the essential characteristics of this invention and, without departing from the spirit and scope thereof, can make various changes and modifications to the invention to adapt it to various usages and conditions.

The invention claimed is:

1. A blower assembly comprising:

a housing including a fluid inlet and a spaced apart fluid outlet;

a blower wheel disposed in the housing, the blower wheel including an inlet ring and plurality of spaced apart blades, a peripheral surface of the inlet ring enclosed by the fluid inlet; and a pre-swirler disposed in the fluid inlet of the housing, the pre-swirler including a plurality of vanes, each of the vanes having a leading edge, a trailing edge, and an outer edge extending between the leading edge and the trailing edge, wherein a blade exposure distance is less than about 10 mm and a blower wheel overlap distance is greater than about 5.5 mm, wherein the blade exposure distance is a distance between a junction point of the trailing edge with the outer edge of each of the vanes of the pre-swirler and an end of a trailing edge of at least one of the blades of the blower wheel, and wherein the blower wheel overlap distance is a distance between the junction point of the trailing edge with the outer edge of each of the vanes of the pre-swirler and the peripheral surface of the inlet ring of the blower wheel, wherein the blade exposure distance is a vertical distance extending parallel to a rotation axis of the blower wheel and the blower wheel overlap distance is a vertical distance extending parallel to the rotation axis of the blower wheel, wherein the pre-swirler includes a central hub, an outer ring, and an inner ring disposed between the central hub and the outer ring, wherein the vanes extend from the central hub to the outer ring through the inner ring, wherein the junction point is positioned between the inner ring and the outer ring, and wherein the junction point is disposed inside the blower wheel.

2. The blower assembly of claim 1, wherein the leading edge of each of the vanes of the pre-swirler is substantially linear and spaced apart from the trailing edge.

3. The blower assembly of claim 1, wherein the outer edge of each of the vanes of the pre-swirler is curved.

4. The blower assembly of claim 1, wherein each of the vanes of the pre-swirler includes at least one of a first surface curved toward a direction of rotation of the blower wheel and a second surface curved toward a direction of rotation of the blower wheel.

5. The blower assembly of claim 1, wherein the trailing edge of each of the vanes of the pre-swirler extends outwardly from the central hub at an angle with respect to the leading edge.

6. The blower assembly of claim 1, wherein the inner ring interconnects the vanes of the pre-swirler.

7. The blower assembly of claim 1, wherein the pre-swirler is substantially stationary relative to the housing.

8. The blower assembly of claim 1, wherein the peripheral surface of the inlet ring is enclosed by the outer ring of the pre-swirler.

9. A blower assembly comprising:

a housing including a fluid inlet and a spaced apart fluid outlet;

a blower wheel disposed in the housing, the blower wheel including an inlet ring and plurality of spaced apart blades, a peripheral surface of the inlet ring enclosed by the fluid inlet; and a pre-swirler disposed in the fluid inlet of the housing, the pre-swirler including a plurality of vanes, each of the vanes having a leading edge, a trailing edge, and an outer edge extending between the leading edge and the trailing edge, wherein a blade exposure distance is in a range of about 4.0 mm to about 9.5 mm and a blower wheel overlap distance is greater than about 5.5 mm, wherein the blade exposure distance is a distance between junction point of the trailing edge with the outer edge of each of the vanes of the pre-swirler and an end of a trailing edge of at least one of the blades of the blower wheel, and wherein the blower wheel overlap distance is a distance between the junction point of the trailing edge with the outer edge of each of the vanes of the pre-swirler and a peripheral surface of the inlet ring of the blower wheel, wherein the blade exposure distance is a vertical distance extending parallel to a rotation axis of the blower wheel and the blower wheel overlap distance is a vertical distance extending parallel to the rotation axis of the blower wheel, wherein the pre-swirler includes a central hub, an outer ring, and an inner ring disposed between the central hub and the outer ring and each of the vanes extends from the central hub to the outer ring through the inner ring, wherein the trailing edge of each of the vanes is continuous from the central hub through the inner ring, and wherein the junction point is disposed inside the blower wheel.

10. The blower assembly of claim 9, wherein the trailing edge of each of the vanes of the pre-swirler extends outwardly from the central hub at an angle with respect to the leading edge.

11. The blower assembly of claim 9, wherein the inner ring interconnects the vanes of the pre-swirler.

12. The blower assembly of claim 9, wherein the peripheral surface of the inlet ring is enclosed by the outer ring of the pre-swirler.

13. A blower assembly comprising:

a housing including a fluid inlet and a spaced apart fluid outlet;

a blower wheel disposed in the housing, the blower wheel including an inlet ring and plurality of spaced apart blades, a peripheral surface of the inlet ring enclosed by the fluid inlet; and a pre-swirler disposed in the fluid inlet of the housing, the pre-swirler including a plurality of vanes, each of the vanes having a leading edge, a trailing edge, and an outer edge extending between the leading edge and the trailing edge, wherein a blade exposure distance is less than about 10 mm and a blower wheel overlap distance is in a range of about 6.5 mm to about 10.0 mm, wherein the blade exposure distance is a distance between a junction point of the trailing edge with the outer edge of each of the vanes of the pre-swirler and an end of a trailing edge of at least one of the blades of the blower wheel, and wherein the blower wheel overlap distance is a distance between the junction point of the trailing edge with the outer edge of each of the vanes of the pre-swirler and the peripheral surface of the inlet ring of the blower wheel, wherein the blade exposure distance is a vertical distance extending parallel to a rotation axis of the blower wheel and the blower wheel overlap distance is a vertical distance extending parallel to the rotation axis of the blower wheel, wherein the pre-swirler includes a central hub, an outer ring, and an inner ring disposed between the central hub and the outer ring and each of the vanes extends from the central hub to the outer ring through the inner ring, wherein the trailing edge of each of the vanes is spaced from the leading edge at a constant angle through the inner ring, and wherein the junction point is disposed inside the blower wheel.

* * * * *